US008245718B2

(12) United States Patent
Büsing et al.

(10) Patent No.: US 8,245,718 B2
(45) Date of Patent: Aug. 21, 2012

(54) PUMP HAVING A HEATING DEVICE

(75) Inventors: Johannes Büsing, Emersacker (DE); Anton Oblinger, Wertingen (DE); Bruno Reiter, Kösingen (DE); David Semerad, Holzheim (DE); Christian Wirth, Dillingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 332 days.

(21) Appl. No.: 12/593,924

(22) PCT Filed: Apr. 2, 2008

(86) PCT No.: PCT/EP2008/053909

§ 371 (c)(1),
(2), (4) Date: Sep. 30, 2009

(87) PCT Pub. No.: WO2008/125488

PCT Pub. Date: Oct. 23, 2008

(65) Prior Publication Data

US 2010/0126534 A1 May 27, 2010

(30) Foreign Application Priority Data

Apr. 12, 2007 (DE) ..... 10 2007 017 271

(51) Int. Cl.
*B08B 3/10* (2006.01)

(52) U.S. Cl. ..... 134/108; 68/15; 415/206

(58) Field of Classification Search ..... 134/105, 134/108; 68/15; 415/206; 416/180
See application file for complete search history.

(56) References Cited

U.S. PATENT DOCUMENTS

| | | | | | |
|---|---|---|---|---|---|
| 2,417,998 | A * | 3/1947 | Wales | 68/12.22 |
| 3,051,182 | A * | 8/1962 | Gibson | 134/108 |
| 3,069,735 | A * | 12/1962 | Toulmin, Jr. | 422/307 |
| 3,187,675 | A * | 6/1965 | Vejde | 417/423.14 |
| 3,918,829 | A * | 11/1975 | Korzec | 415/119 |
| 4,594,500 | A * | 6/1986 | Wright | 392/471 |
| 4,818,193 | A * | 4/1989 | Laing et al. | 417/423.15 |
| 4,932,837 | A * | 6/1990 | Rymal | 415/206 |
| 6,164,910 | A * | 12/2000 | Mayleben | 415/214.1 |
| 6,736,598 | B2 * | 5/2004 | Kleemann et al. | 415/176 |
| 7,965,928 | B2 * | 6/2011 | Eichholz et al. | 392/417 |
| 2002/0048513 | A1 | 4/2002 | Kleemann et al. | |

(Continued)

FOREIGN PATENT DOCUMENTS

DE 35 30 531 * 3/1987

(Continued)

OTHER PUBLICATIONS

European Patent Office 0 898 928 Mar. 1999.*

(Continued)

*Primary Examiner* — Frankie L Stinson
(74) *Attorney, Agent, or Firm* — James E. Howard; Andre Pallapies

(57) ABSTRACT

A pump, particularly for dishwashers, is provided and includes a housing made of a housing bottom, a housing cover, and a heating device disposed in between the bottom and cover for heating a washing fluid. The heating device forms a ring-shaped side wall of the housing. An impeller is arranged in the housing, an intake connection is arranged axially in the housing cover relative to the axis of rotation of the impeller, and a pressure connection is arranged in the housing cover.

18 Claims, 5 Drawing Sheets

U.S. PATENT DOCUMENTS

| | | | | |
|---|---|---|---|---|
| 2004/0071573 | A1 | 4/2004 | Pfetzer et al. | |
| 2004/0173249 | A1 * | 9/2004 | Assmann et al. | 134/94.1 |
| 2005/0201858 | A1 * | 9/2005 | Wang | 415/126 |
| 2005/0201878 | A1 | 9/2005 | Kraffzik | |

FOREIGN PATENT DOCUMENTS

| | | | |
|---|---|---|---|
| DE | 36 27 732 | * | 2/1988 |
| DE | 198 52 270 | * | 5/2000 |
| DE | 198 52 569 | * | 5/2000 |
| DE | 20107363 U1 | | 8/2001 |
| FR | 2 624 217 | * | 6/1989 |
| GB | 1398148 | | 6/1975 |
| GB | 2427437 A | | 12/2006 |
| JP | 52-050001 | * | 4/1977 |
| JP | 10-103297 | * | 4/1998 |
| JP | 10-184581 | * | 7/1998 |
| WO | 2006027331 A1 | | 3/2006 |

OTHER PUBLICATIONS

European Patent Office 1 247 993 Oct. 2001.*
WIPO WO 2006/027331 Mar. 2006.*

* cited by examiner

PUMP HAVING A HEATING DEVICE

BACKGROUND OF THE INVENTION

The present invention relates to a pump, in particular for dishwashers, comprising a housing consisting of a housing base, a housing cover and a heating device disposed therebetween for the purpose of heating a washing liquor, the device forming a ring-shaped side wall of the housing, further comprising an impeller arranged in the housing, an intake port arranged axially in the housing cover relative to the axis of rotation of the impeller, and a discharge port.

A pump of said kind for dishwashers is known from DE 201 07 363 U1. A disadvantage with said pump is the vertical arrangement of the discharge port with respect to the axially arranged intake port. The discharge port projects beyond the basic cylindrical shape of the pump, resulting in a greater extension of the pump in the radial direction. The pump requires more installation space and reduces the useful volume of the dishwasher. A further disadvantage of said pump is the small effective heating surface of the ring-shaped heating device, which furthermore is opened up by the discharge port. In order to be able to heat the washing liquor in a short time it is necessary to make available to the heating device a high heating capacity with correspondingly high temperatures. This can lead to problems such as, for example, premature aging, particularly at the connection points between the heating device and the adjacent plastic parts, at which points sealing elements may also be present. This results in porosity of the sealing material or, as the case may be, of the adjacent plastic parts and consequently leads to leaks in the appliances.

BRIEF SUMMARY OF THE INVENTION

The object underlying the invention is to disclose a simple and inexpensive pump of the type cited in the introduction which has smaller external dimensions, in particular in the radial direction, while avoiding the aforementioned disadvantages.

This object is achieved according to the invention in the case of a pump of the type cited in the introduction in that the discharge port is arranged in the housing cover. Arranging the discharge port in the cover enables the external dimensions of the pump to be reduced in the radial direction relative to its longitudinal axis. The installation space, in particular the installation height required for the pump, is reduced as a result. If the pump is installed horizontally underneath the washing tub with the longitudinal axis of the pump parallel to the bottom of the washing tub, valuable installation height can be saved. The useful volume of the washing tub can be increased in size as a result.

Preferably it is provided that a longitudinal axis of the intake port is arranged at an acute angle relative to the longitudinal axis of the discharge port. In addition the intake port can be connected directly to a drain at the sump of the washing tub via very short connecting elements or even without connecting elements and the discharge port can be connected to a feed line to the spray system. With an arrangement of two connections corresponding to the intake port and discharge port at the sump, additional parts such as hoses and their fastening means can be dispensed with.

The arrangement of intake port and discharge port in the cover inventively enables a simple design of the heating device, specifically having a tube with closed circular ring-shaped cross-section. Expensive and labor-intensive manufacturing redesign or machining steps for an opening in the heating device can thus be dispensed with. It can therefore be manufactured largely using standard parts. Furthermore, the washing liquor can be heated more uniformly in a tube without openings than in a ring having openings because a large-area undisturbed flow of the water along the entire lateral surface of the tube is established.

A tube of this type is also easy to replace. Moreover, with a tubular side wall a structurally simpler design of the housing of the pump is possible, wherein the housing cover and the housing base can be made from plastic and the tubular side wall can be manufactured separately from metal. As well as allowing cost-effective production of the complex geometries of the housing cover and the base, the use of plastic also enables the overall weight of the pump to be reduced. Plastic is also a poor conductor of heat, which means that the heated washing liquor can be circulated in the pump virtually without energy loss. The tube of the heating device is advantageously made of metal, since owing to its good heat-conducting properties it transfers a maximum of the heat energy to the washing liquor.

Furthermore the housing cover can be produced also using the injection molding method, for example, without involving appreciable additional overhead for the discharge port. The certain complexity, already present, of the shape of the cover on account of the intake port is not significantly increased as a result of the additional arrangement of the discharge port.

The thermal energy required for heating the washing liquor is provided according to the invention by a heating means that is in contact with the tube of the heating device from outside.

For example, thick-film resistors, tubular heating elements or heating wires that directly touch the outside of the tube can be used as heating means. Since there are no interruptions in the tube, the orientation of the heating means on the tube is essentially freely selectable. The heating means can be disposed e.g. in the form of rings arranged parallel to one another, in a spiral shape or as flat strips at right angles or parallel to the tube's longitudinal axis. The method for attaching the heating means to the lateral surface of the tube, for example by printing the tube with the thick-film resistor material, is made easier as a result. The heating device can have a temperature sensor, for example an NTC or PTC resistor, as protection against overheating.

The tube can also consist of temperature-resistant plastic, in particular electrically conductive plastic. In this embodiment variant the heating means can already be integrated into the tube, with the result that the application of heating means can be eliminated as a production step.

According to the invention the intake port projects centrally into the region of the heating device and extends as far as the impeller on the end face side while forming a radial gap. In addition to enabling a compact design this has the advantage that the washing liquor sucked in through the intake port can be conducted in a targeted manner in a uniform axial flow right up to the intake aperture of the impeller. During the operation of the pump the washing liquor sucked in through the intake port can already be preheated as the housing parts and consequently also the intake port are heated correspondingly. This effect can be reinforced by additional heating means in or at the intake port.

The flow of the washing liquor sucked in from the direction of the cover is redirected through 180 degrees in the impeller and then flows in a spiral shape coaxially to the sucked-in washing liquor in a ring-cylindrical space on the inside of the heater back to the cover. In order that this flow reversal process proceeds with minimum energy loss, in an advantageous embodiment of the invention the impeller has cover disks curved in the direction of the housing cover for the purpose of redirecting the axially sucked-in washing liquor flow in the axially opposing direction toward the discharge port. Toward that end the cover disks can be curved in a hemispherical shape in order to redirect the washing liquor drawn in axially centrally or, as the case may be, centrally by the impeller from the intake port between the cover disks of the impeller on a curved path virtually fully through 180 degrees. The outer diameter of the cover disk pointing toward the intake port is smaller than that of the opposing cover disk, since in that way the washing liquor can be optimally redirected into the hollow-cylindrical space.

The blades of the impeller responsible for the pump effect can also assist the redirection of the flow by means of their shape and arrangement. In a further advantageous embodiment of the invention the impeller has radially angled blades. The blades can be curved over their entire radial length and in the direction of the pressure-side outlet openings of the impeller. In this arrangement the curvature can be more pronounced at the ends of the blades in order to impart the desired flow direction to the flow upon its emersion from the impeller.

In the region of the outlet openings of the impeller the flow has a large radial direction component owing to the rotation of the impeller. According to a further preferred embodiment variant of the invention, a guide mechanism to further facilitate flow redirection can therefore be arranged between the impeller and the discharge port. It can consist of fixed guide blades which are arranged in a ring shape downstream of the outlet opening of the impeller. The guide blades can extend radially slightly angled in the ring-cylindrical space. Their blade surface can be curved in order to further counteract the swirl of the flow emerging from the impeller. This leads to an increase in the flow component in the axial direction.

According to a further advantageous embodiment of the invention the guide mechanism is arranged on the cover. For that purpose the guide mechanism can be permanently joined to the cover as an independent part or else be integrally molded on the cover as a single piece. A single-piece embodiment requires fewer individual parts and therefore reduces the cost of manufacturing the pump housing.

In a further advantageous embodiment variant of the invention the housing cover has spiral-shaped guide elements for directing the flow of the washing liquor from the heating device into the discharge port. The guide elements facilitate the transition of the washing liquor from the ring-cylindrical space into the cylinder-shaped discharge port by focusing the flow in the direction of the discharge port. The guide elements are preferably integrally molded in the shape of guide spirals fixedly in the cover on the outside around the intake port. They are to be embodied in such a way that the transition of the washing liquor into the discharge port takes place without significant loss of kinetic energy.

In the manufacture of the cover from plastic, too, there are limits to the complexity of the manufacturable geometries due to production constraints. Said limits are reached, for example, if it were no longer possible to remove parts nondestructively from the casting mold after the casting process on account of undercuts. In an alternative advantageous embodiment variant of the invention the housing cover therefore consists at least partially of an elastomer. This allows the cover to be removed from the mold nondestructively even in the case of very complex geometries. Furthermore, owing to its rubber-elastic properties the elastomer part of the cover possesses the capability to adapt to the washing liquor flow to a large extent during the redirection from the heating device into the discharge port. As a result special spiral-shaped guide elements for guiding the flow can be largely dispensed with.

In order to make sure that the cover made of the elastomer material fulfills the requirements in terms of stability and shape retention with respect to parts adjacent to it—in particular the impeller—in an advantageous embodiment of the invention rigid molded parts can be used to stiffen the housing cover. They can ensure a defined position in particular of the intake port with respect to the impeller in order to rule out collisions. Furthermore the leak-tightness of a rigid part of the cover e.g. with respect to the heating device can be ensured with greater reliability. In this case sections of the elastic cover are clamped tight between the tube of the heating device and the rigid molded parts.

BRIEF DESCRIPTION OF THE DRAWINGS

The principle of the invention is explained in more detail below by way of example with reference to a drawing, in which.

DETAILED DESCRIPTION OF EXEMPLARY EMBODIMENTS OF THE PRESENT INVENTION

Figure 1:
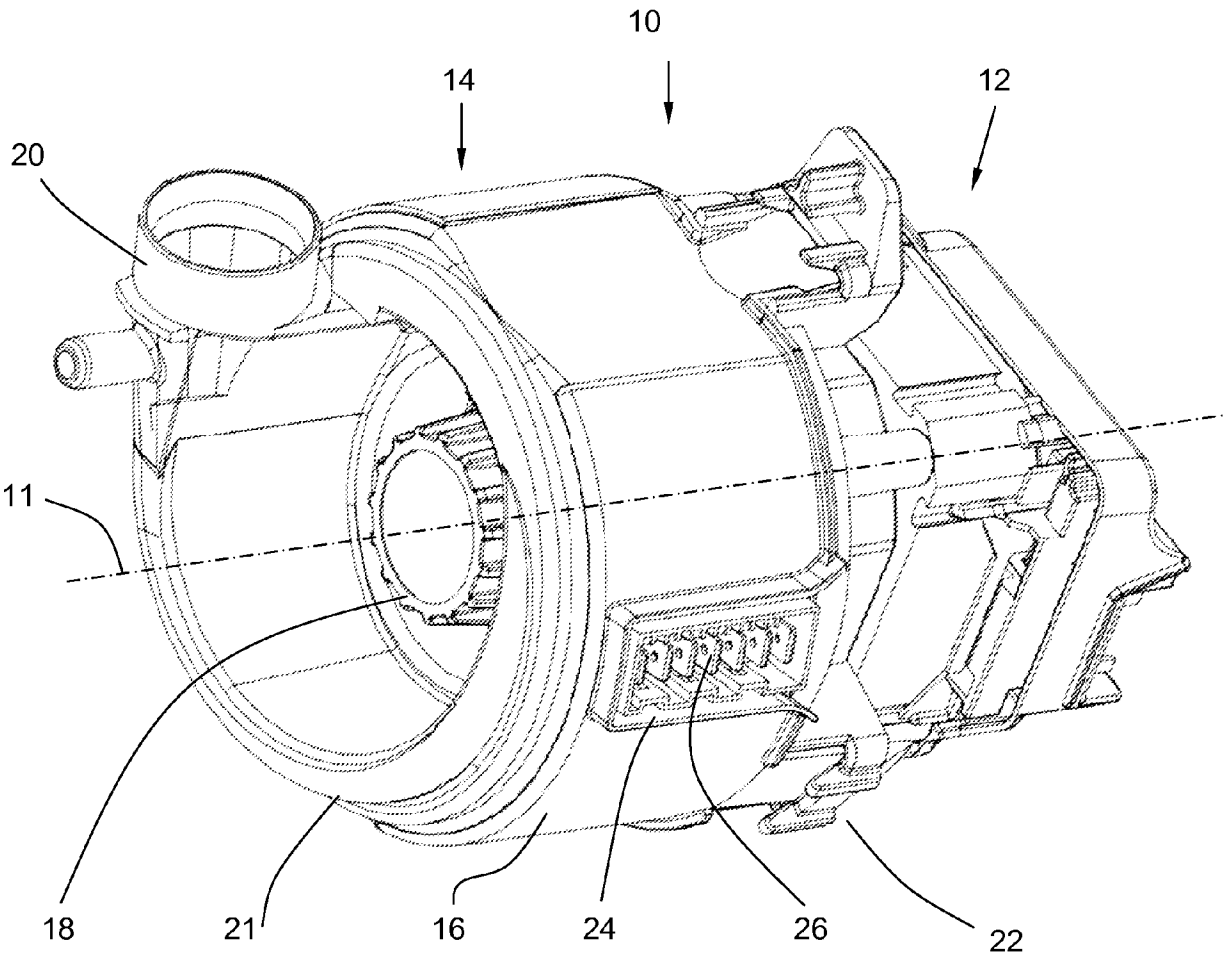
FIG. 1: shows a perspective view of a first embodiment variant of the pump according to the invention.

FIG. 1 shows a first embodiment variant of a pump 10 according to the invention which consists of two main assemblies, namely an electric motor 12 and a hydraulic part 14 contiguous thereto. The hydraulic part 14 is enclosed by a substantially hollow-cylindrical housing cover 16 in which an intake port 18 is arranged concentrically with respect to a longitudinal axis 11 of the pump 10. Viewed from the outside a discharge port 20 is integrally molded on the front end face of the housing cover 16 which runs out of line with respect to the axis 11 (cf. FIG. 2). The housing cover 16 has connecting elements 22 by means of which the pump 10 is secured inside a dishwasher. Arranged externally on the lateral surface of the housing cover 16 is a multipoint connector 24 having seven contact tabs 26 disposed in parallel next to one another for the purpose of supplying power to the pump 10.

During operation the pump 10 sucks washing liquor out of a washing tub of a dishwasher centrally via the intake port 18. Inside the housing cover 16 the washing liquor is heated before being pumped back via the discharge port 20 into the washing tub of the dishwasher once again. The washing liquor is heated in this case by means of a heating device (cf. FIG. 2) which likewise obtains its energy via the contact tabs 26 of the multipoint connector 24.

The very compact design of the pump 10, in particular the small outer diameter of the hydraulic part 14, which is not substantially greater than that of the electric motor 12, enables the pump 10 to be installed in a prone position, which is to say that its longitudinal axis 11 runs essentially horizontally.

Figure 2:
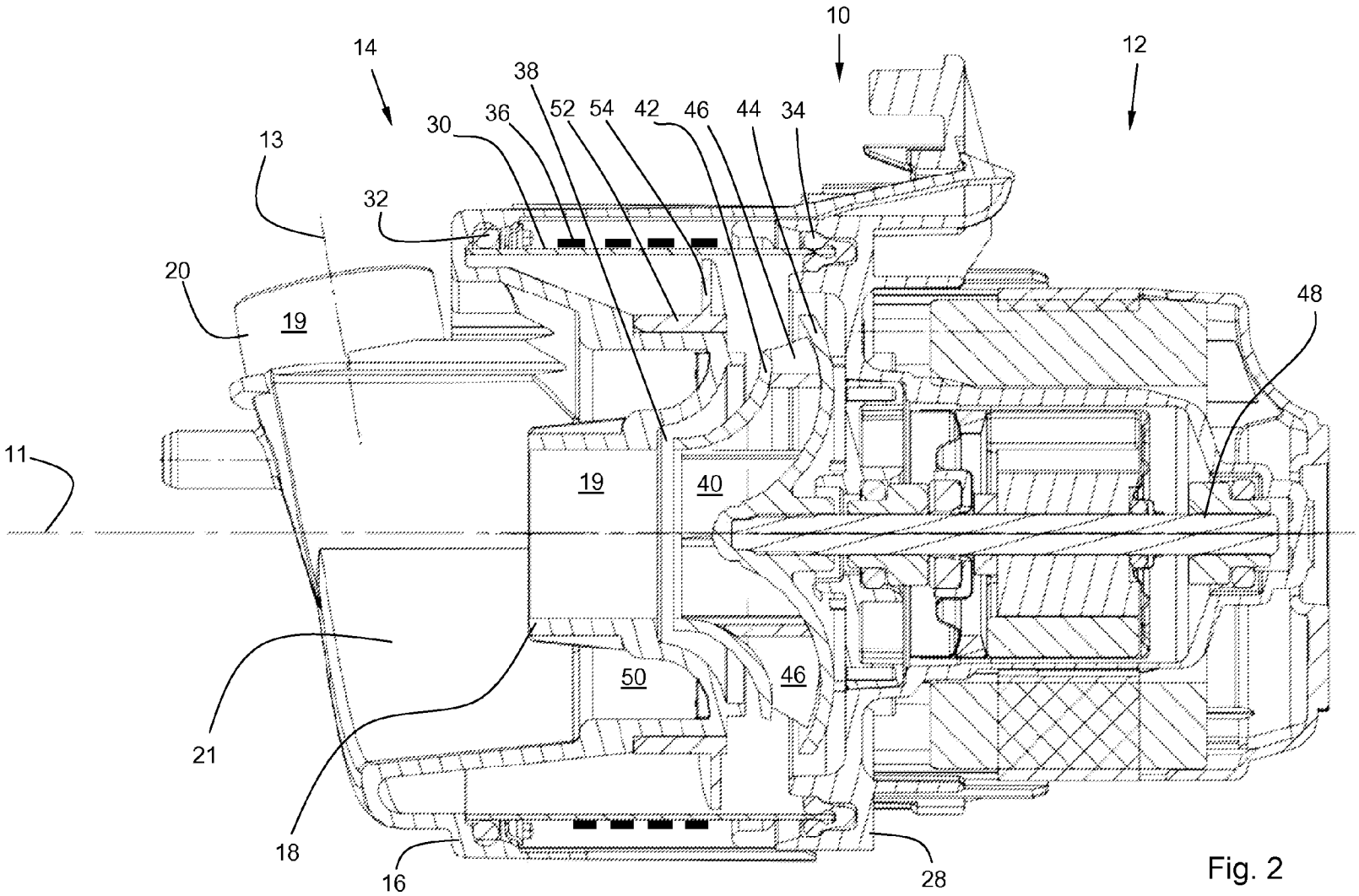
FIG. 2: shows an axial longitudinal section through the pump shown in FIG. 1.

FIG. 2 shows an axial longitudinal section through the pump 10 shown in FIG. 1. A housing base 28 of the hydraulic part 14 adjoins the front end face of the electric motor 12 and extends as far as the housing cover 16. Integrally molded on the front end face of the latter is the discharge port 20 whose longitudinal axis 13 is arranged at an acute angle to the longitudinal axis (13) of the discharge port (20, 120). Located between the housing base 28 and the housing cover 16 is a metal tube 30 without openings which is connected via a sealing element 32 to the housing cover 16 and via a sealing element 34 in a liquid-tight manner to the housing base 28. Four ring-shaped thick-film resistors 36 running circumferentially and spaced apart from one another are printed on the lateral surface of the metal tube 30.

Arranged centrally in the housing cover 16 is the intake port 18 which adjoins an impeller 40 with one of its front end faces while forming a radial gap 38. The impeller 40 consists of a cover disk 42 pointing toward the intake port 18 and an opposing cover disk 44 pointing toward the housing base 28. The blades 46 of the impeller 40 extend between the two curved cover disks 42 and 44. The impeller 40 is connected in a rotationally fixed manner to one end of a shaft 48 of the electric motor 12 which projects through the housing base 28 into the hydraulic part 14.

A guide mechanism 52 having angled guide blades 54 is inserted onto a flange-like section 50 of the housing covers 16 approximately at the level of the impeller 40. The housing cover 16 also has spiral-shaped guide elements, a guide spiral 21 for guiding the flow of the washing liquor from the heating device 30, 36 into the discharge port 20.

Figure 3:
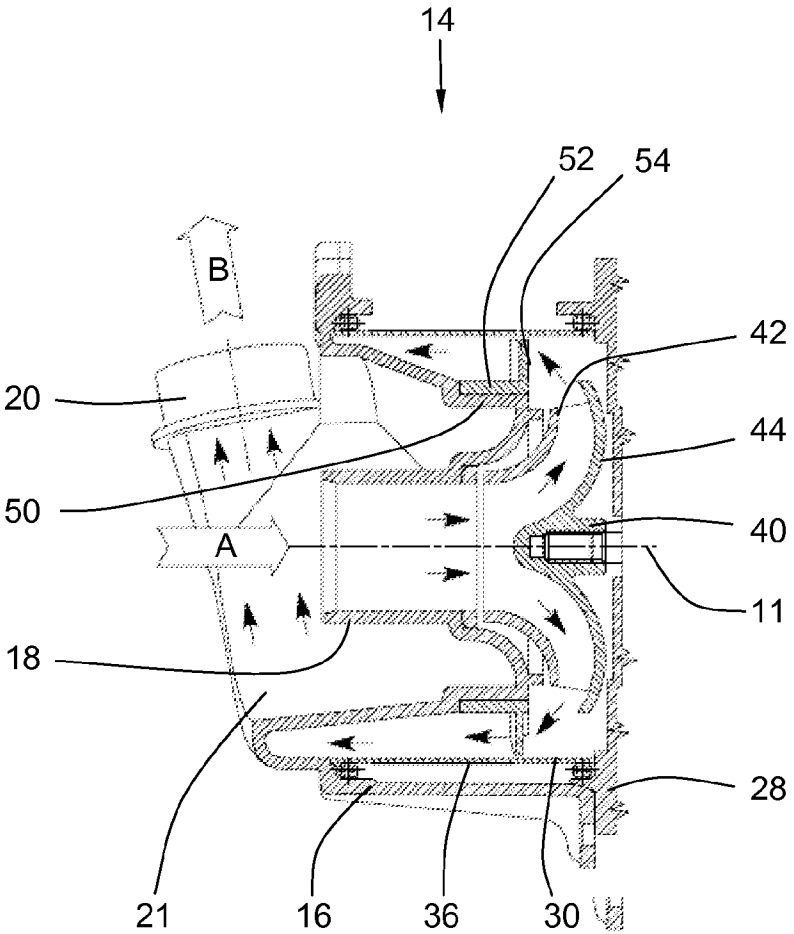
FIG. 3: shows the hydraulic part of the pump shown in FIG. 2.

During operation of the pump 10 the impeller 40 sucks in washing liquor from a washing tub of a dishwasher through the intake port 18 and presses it radially outward as a result of the centrifugal force. Owing to the curvature of the cover disks 42 and 44 the washing liquor is redirected in the process in the radial direction along a curved path in the direction of the guide blades 54 of the guide mechanism 52 by more than 90 degrees parallel to the pump's longitudinal axis 11. To more clearly illustrate the flow path of the washing liquor through the hydraulic part 14, said flow path is shown separately in FIG. 3, with the respective flow direction being symbolized by arrows.

The washing liquor subsequently strikes the inside of the metal tube 30, not vertically, but at an angle relative to the longitudinal axis 11. The guide blades 54 of the guide mechanism 52 then help to redirect the washing liquor flow A arriving axially via the intake port 18 in the direction of the discharge port 20. The redirected washing liquor flow then flows along the inside of the metal tube 30 heated by the thick-film resistors 36 and in the process is brought to a desired temperature. This can be accomplished in a short time uniformly and with a relatively small input of energy owing to the length of the tube 30 and the number of thick-film resistors 36. The speed at which the washing liquor flows past on the inside of the tube 30 can be influenced with the aid of the angle of incidence of the guide blades 54 of the guide mechanism 52. The blades can be adjusted for that purpose for example in a program-dependent manner by an actuator connected to a control device.

The rotation of the impeller 40 causes the washing liquor to flow in a spiral shape in the direction of the discharge port 20. At the same time the guide blades 54 of the guide mechanism 52 translate rotatory motion components of the flow into horizontal motion components, with the result that the washing liquor reaches the discharge port sufficiently quickly through a ring-cylindrical space on the inside of the heating device 30, 36. The guide spiral 21 concentrates the flow and imparts to it a largely laminar characteristic upstream of the discharge port 20, through which the washing liquor leaves the hydraulic part 14 again in the direction B.

Figure 4:
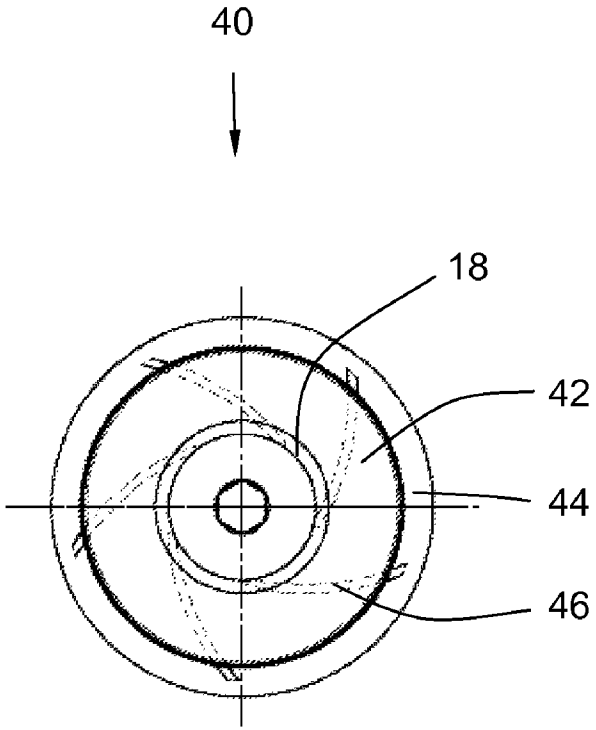
FIG. 4: shows a front view of the impeller shown in FIG. 2.

FIG. 4 shows an individual illustration of the impeller 40 in a plan view. It has a cover disk 42 with a smaller outer diameter and a cover disk 44 with a larger outer diameter. Five rotor blades 46 are arranged between the two cover disks 42, 44 and are curved in the radial direction. The washing liquor enters the impeller 40 centrally via the intake port 18, is pressed radially outward by the rotor blades 46 between the cover disks 42, 44 as a result of the centrifugal force and exits the impeller 40 again via its outer circumference.

Figure 5:
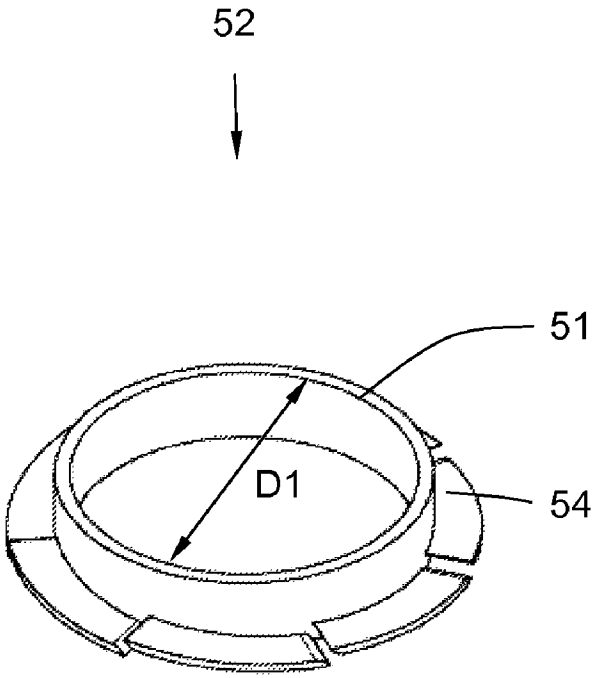
FIG. 5: shows a perspective view of the guide mechanism shown in FIG. 2.

FIG. 5 shows an individual illustration of the guide mechanism 52 in a perspective view. The ring-shaped guide mechanism 52 contains slightly angled guide blades 54 pointing radially outward and integrally molded onto a ring 51. The inner diameter D1 of the ring 51 corresponds to the outer diameter of the flange-like section 50 of the housing cover 16 onto which the guide mechanism 52 is pressed such that it sits in a rotationally fixed manner on the flange-like section 50.

Figure 6:
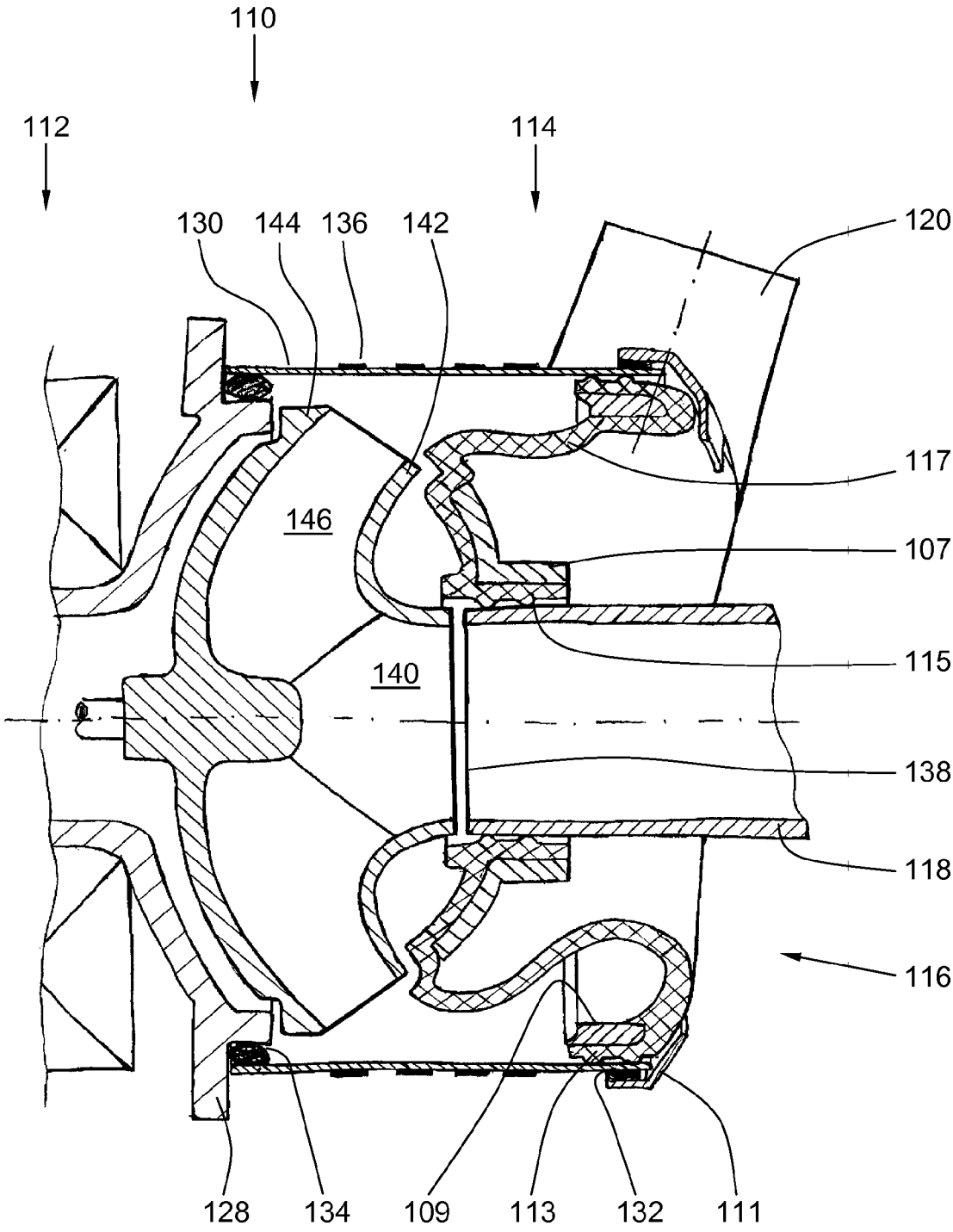
FIG. 6: shows an axial longitudinal section through a second embodiment variant of the pump according to the invention.

FIG. 6 shows a further embodiment variant of an inventive pump 110 having an indicated electric motor 112 and a hydraulic part 114. In contrast to the embodiment variant shown in FIGS. 1 to 5, the pump 110 has a housing cover 116 which essentially consists of an elastomer part 117 with rubber-elastic properties. In this arrangement the elastomer part 117 of the cover 116 mainly replaces the guide spiral known from the first embodiment variant.

The elastomer part 117 abuts a central intake port 118 in a leak-tight manner via two ring-shaped ribs 115. The elastomer part 110 is sealed off from a metal tube 130 via two further ribs 113. The metal tube 130 printed with the thick-film resistors 136 is connected on the front end face to a housing base 128 via a sealing element 134 on one side and to an inherently shape-stable ring-shaped cover element 111 via a sealing element 132 on the other side.

Rigid molded parts are provided at the connecting points between the elastomer part 117 and the intake port 118 or, as the case may be, the tube 130 such that the contact pressing force necessary for leak tightness acts at said points. A rigid stiffening ring 107 is arranged at the connecting point to the intake port 118 and a rigid stiffening ring 109 is arranged at the connecting point to the metal tube 130. The stiffening ring 107 formed in an angled shape in cross-section also serves to maintain the inherent shape stability of the elastomer part 117 in the region of the impeller 140. In this way it is also ensured that the elastomer part 117 does not collide with the cover disk 142 of the impeller 140 during operation of the pump 110. At the same time this section of the elastomer part 117, kept stable in its shape by means of the stiffening ring 107, serves to form a radial gap 138 between the cover disk 142 of the impeller 140 and the intake port 118.

Owing to the rubber-elastic properties of the elastomer part 117 of the housing cover 116 it is possible, in the case of this embodiment variant in contrast to the embodiment variant shown in FIGS. 1 to 5, largely to dispense with a guide mechanism and a guide spiral. The elastomer part 117 adapts to the washing liquor flow in its elastic region, thereby ensuring an optimal flow transition into the discharge port 120.

LIST OF REFERENCE SIGNS

10, 110—Pump
11, 13—Longitudinal axis
12, 112—Electric motor
14, 114—Hydraulic part
16, 116—Housing cover
18, 118—Intake port
19—Tubular region
20, 120—Discharge port
21—Guide spiral
22—Connecting element

24—Multipoint connector
26—Contact tab
28, 128—Housing base
30, 130—Metal tube
32, 34, 132, 134—Sealing element
36, 136—Thick-film resistor
38, 138—Radial gap
40, 140—Impeller
42, 142, 44, 144—Cover disk
46, 146—Rotor blade
48—Shaft
50—Flange-like section
51—Ring
52—Guide mechanism
54—Guide blade
107, 109—Stiffening ring
111—Ring-shaped cover element
113, 115—Ribs
117—Elastomer part of the housing cover 116
A, B—Flow direction of the washing liquor
D1—Inner diameter

The invention claimed is:

1. A pump, in particular a pump for dishwashers, the pump comprising:

a housing, the housing including a housing base and a housing cover, and having a longitudinal axis;

a heating device, the heating device being located between the housing base and the housing cover, being operable to heat a washing fluid, and forming a portion of a side wall of the housing;

an impeller, the impeller being located in the housing cover and rotatable about an axis of rotation;

an intake port, the intake port guiding washing fluid into an intake stream flowing into the impeller and the intake port being located upstream of the impeller relative to a direction of flow of washing fluid as viewed along the axis of rotation of the impeller; and a discharge port having a longitudinal axis, the discharge port being located in the housing cover, wherein the longitudinal axis of the discharge port is not parallel to the longitudinal axis of the housing, and the intake port guides washing fluid into an intake stream flowing into the impeller, the intake stream flowing in a longitudinal direction along the longitudinal axis of the housing from the housing cover toward the housing base, and the impeller has a plurality of cover disks curved generally in a direction opposite to the longitudinal direction, the cover disks operating to promote a change in the direction of flow of washing fluid from the longitudinal direction from the housing cover toward the housing base to the direction opposite to the longitudinal direction.

2. The pump as claimed in claim 1, wherein the intake port has a longitudinal axis, and the longitudinal axis of the intake port is at an acute angle relative to the longitudinal axis of the discharge port.

3. The pump as claimed in claim 1, wherein the heating device includes a tube having a closed periphery annular cross-section.

4. The pump as claimed in claim 1, wherein the heating device includes a heating component in contact with the tube on an outer periphery of the tube.

5. The pump as claimed in claim 1, wherein the intake port projects into the heating device and extends to the vicinity of an upstream end portion of the impeller whereat the intake port extends in partial axial overlap with the upstream end portion of the impeller and at a radially outward spacing therefrom such that there is a radial gap between the intake port and the upstream end portion of the impeller.

6. The pump as claimed in claim 1, wherein the impeller has a plurality of radially angled blades.

7. The pump as claimed in claim 1 and further comprising a guide component located axially between the impeller and the discharge port, the guide component promoting a change in the direction of flow of washing fluid from a longitudinal direction along the longitudinal axis of the housing from the housing cover toward the housing base to a direction opposite to the longitudinal direction.

8. The pump as claimed in claim 7, wherein the guide component is located on the housing cover.

9. The pump as claimed in claim 1, wherein the housing cover includes a plurality of generally spiral shaped guide elements, the guide elements promoting a flow of washing fluid from the heating device toward the discharge port.

10. The pump as claimed in claim 1, wherein the housing cover is formed at least partially of an elastomer.

11. The pump as claimed in claim 1 and further comprising a plurality of rigid molded components for stiffening the housing cover.

12. A water-conducting household appliance, in particular a dishwasher, the water-conducting household appliance comprising:

an area in which items are subjected to a treatment involving a washing fluid; and a pump, the pump including a housing having a longitudinal axis, a heating device, an impeller, an intake port, and a discharge port having a longitudinal axis, wherein the housing includes a housing base and a housing cover, the heating device is located between the housing base and the housing cover, being operable to heat a washing fluid, and forming a portion of a side wall of the housing, the impeller is located in the housing cover and is rotatable about an axis of rotation the intake port guides washing fluid into an intake stream flowing into the impeller and the intake port is located upstream of the impeller relative to a direction of flow of washing fluid as viewed along the axis of rotation of the impeller, the discharge port is located in the housing cover, and the longitudinal axis of the discharge port is not parallel to the longitudinal axis of the housing, and the intake port guides washing fluid into an intake stream flowing into the impeller, the intake stream flowing in a longitudinal direction along the longitudinal axis of the housing from the housing cover toward the housing base, and the impeller has a plurality of cover disks curved generally in a direction opposite to the longitudinal direction, the cover disks operating to promote a change in the direction of flow of washing fluid from the longitudinal direction from the housing cover toward the housing base to a direction opposite to the longitudinal direction.

13. The appliance as claimed in claim 12, wherein the intake port has a longitudinal axis, and the longitudinal axis of the intake port is at an acute angle relative to the longitudinal axis of the discharge port.

14. The appliance as claimed in claim 12, wherein the heating device includes a tube having a closed periphery annular cross-section.

15. The appliance as claimed in claim 14, wherein the heating device includes a heating component in contact with the tube on an outer periphery of the tube.

16. The appliance as claimed in claim 12, wherein the intake port projects into the heating device and extends to the vicinity of an upstream end portion of the impeller whereat the intake port extends in partial axial overlap with the upstream end portion of the impeller and at a radially outward spacing therefrom such that there is a radial gap between the intake port and the upstream end portion of the impeller.

17. The appliance as claimed in claim 12 and further comprising a guide component located axially between the impeller and the discharge port, the guide component promoting a change in the direction of flow of washing fluid from a longitudinal direction along the longitudinal axis of the housing from the housing cover toward the housing base to a direction opposite to the longitudinal direction.

18. The appliance as claimed in claim 12, wherein the housing cover includes a plurality of generally spiral shaped guide elements, the guide elements promoting a flow of washing fluid from the heating device toward the discharge port.

* * * * *